US006871376B1

(12) United States Patent
D'Ambrosio

(10) Patent No.: US 6,871,376 B1
(45) Date of Patent: Mar. 29, 2005

(54) PAINT ROLLER

(76) Inventor: Sandro D'Ambrosio, 12322 Ernest Robitaille, Montreal, Quebec (CA), H1G-3Y3

( * ) Notice: Subject to any disclaimer, the term of this patent is extended or adjusted under 35 U.S.C. 154(b) by 0 days.

(21) Appl. No.: 10/335,172

(22) Filed: Dec. 31, 2002

(51) Int. Cl.[7] ..... B05C 17/02
(52) U.S. Cl. ..... 15/230.11; 492/13; 492/19
(58) Field of Search ..... 15/230.11; 492/13, 492/14, 19

(56) References Cited

U.S. PATENT DOCUMENTS 2,765,486 A * 10/1956 Anderson ..... 15/230.11
2,936,474 A * 5/1960 Custer ..... 15/230.11
5,412,832 A * 5/1995 Irven ..... 15/230.11
6,148,469 A * 11/2000 Irven ..... 15/230.11

* cited by examiner

*Primary Examiner*—Gary K. Graham

(57) ABSTRACT

A paint roller having a stretchable cylindrical paint sock, which is pulled over both ends of an outer roller tube and attached by screw-cap means, with the outer end being stretched over a swivel end-cap capable of providing a roller end angle up to about 30-degrees, thereby allowing paint to be dispensed in a corner without applying paint to the adjacent perpendicular surface. In operation, as the roller turns, the paint sock is outwardly stretched over the swivel end-cap, extending the roller sock line of contact with the wall surface, thereby continuously applying paint in a straight line along the corner.

12 Claims, 5 Drawing Sheets

PAINT ROLLER

BACKGROUND OF THE INVENTION

1. Field of the Invention

The present invention relates to a paint roller for use in connection with hand painting the walls of a house or structure. The paint roller has particular utility in rolling the corner of a wall without getting paint on the adjacent perpendicular surface.

2. Description of the Prior Art

The use of paint rollers are desirable over paint brushes due to their speed, convenience, and the overall results obtained from their use. For example, when painting a room in one's house, the large area of the walls and ceiling can be painted quickly with a paint roller, with only the corners offering some difficulty. Often the painter is slowed down by the need to brush the corners first and then roll up to the brushed area in order to prevent paint on the end of the roller from getting on to the adjacent perpendicular wall. Using both a roller and brush can cause the undesirable visible condition that the texture of the brush is different from that of the roller. Even worse is the case where the two adjoining walls are painted a different color, where it is not acceptable for any of the paint to get on the adjacent wall, ceiling, or other surface.

The use of paint rollers is well known in the prior art, with some addressing the problem of rolling in corners discussed earlier. For example, U.S. Pat. No. 5,412,832 to Irven discloses an edge paint roller that specifically addresses the issue of painting in corners using an angled end portion of the roller. However, the paint roller disclosed in this patent has a fixed built-in angle, and cannot automatically adjust to an application.

U.S. Pat. No. 5,444,891 to Benson and U.S. Pat. No. 5,623,740 to Buns et al. disclose paint rollers that have a removable edge guard, which can be attached for painting corners. However, the thickness of these shields and the gap between the shield and the end of the roller prevents the ability to paint all the way into a corner. This approach also has the further drawback of paint collecting on the shield and eventually spreading on to the adjacent perpendicular surface.

Similarly, U.S. Pat. No. 5,769,769 to Torntore discloses a power roller with an edger device that applies a removable cap on the outer end of the roller to prevent paint from being applied outwardly from the end of the roller. However, there is nothing to prevent the outside surface of this cap or edger device from building up paint, which is then transferred to the adjacent perpendicular surface.

Lastly, U.S. Pat. No. 5,613,264 to Knowles discloses a paint roller corner cover, which covers the end of the roller. However, the purpose of the cover disclosed in this patent is to paint around the corner, as compared to painting up to a corner without getting paint on the adjacent perpendicular wall.

While the above-described devices fulfill their respective, particular objectives and requirements, the aforementioned patents do not describe a paint roller that can automatically adjust for painting in various shaped corners while keeping paint off any adjacent surfaces. It might appear that the outer end of a conventional paint roller could be cut at an angle and used for painting in corners, but as the roller turns this would paint a sinusoidal line in the corner as compared to a desired straight line. Therefore, a need exists for a new and improved paint roller with a simple and inexpensive corner mechanism that can be used for painting large surfaces and corners, without applying paint to the adjacent surfaces. In this regard, the present invention substantially fulfills this need. In this respect, the paint roller according to the present invention substantially departs from the conventional concepts and designs of the prior art, and in doing so provides an apparatus primarily developed for the purpose of applying paint in corners, while keeping paint off adjacent perpendicular surfaces. The present patent discloses a roller that has a simple swivel end cap, which automatically swivels to the required angle for painting corners, thereby preventing the transfer of paint on to any undesired surfaces.

SUMMARY OF THE INVENTION

In view of the foregoing disadvantages inherent in the known types of paint rollers now present in the prior art, the present invention provides an improved paint roller, and overcomes the above-mentioned disadvantages and drawbacks of the prior art. As such, the general purpose of the present invention, which will be described subsequently in greater detail, is to provide a new and improved painting apparatus, which has all the advantages of the prior art mentioned heretofore and additional novel features that result in a paint roller which is not anticipated, rendered obvious, suggested, or even implied by the prior art, either alone or in any combination thereof.

To attain this, the present invention essentially comprises a paint roller that has an outer swivel end that can automatically set to an angle up to about 30-degrees for painting in a corners without applying paint to the adjacent surface. The roller uses a flexible cylindrical paint sock, which is stretched over an outer roller tube and attached at both ends using screw caps so that when the outer angled end of the roller rotates, the length of the roller sock extends in length along the line of contact between the roller and the surface being painted. This keeps the extended portion of the paint sock in the corner, thereby painting a straight line while keeping the remaining portion of the roller's end circumference away from the adjacent surface.

The paint roller is constructed on a rod, which has a straight roller arm portion and a handle portion at right angles to the roller arm portion. A rotatable inner tube for supporting a swivel ball and swivel cap assembly is removably mounted to the roller arm portion. The swivel ball with attached outer swivel cap is attached to the outer end of the inner tube. An outer roller tube is concentrically placed over the inner tube and supported by a rotatable end-cap/screw at the handle end of the roller arm and by a rotatable swivel end-cap and swivel screw at the outer swivel end of the roller. The swivel cap automatically sets to place the outer end cap at an angle up to about 30-degrees relative to a reference perpendicular to the roller arm, thereby providing an outer roller end angle. The cylindrical paint sock is pulled over the outer roller tube, stretched over the two circular end caps and secured at the handle end by an end-cap/screw and at the outer swivel end by a swivel end-cap and swivel screw.

In operation, when the operator presses the end of the roller in a corner, the swivel end adjusts at an angle to place the extended portion of the swivel end cap in the corner, stretching the paint sock in the direction along the roller arm axis. This provides an angle at the end of the roller where all points on the circumference, except for the point of contact, is tilted at an angle away from the adjacent surface. As the rollers and swivel turn, the roller sock is stretched out over the outer swivel circular end cap, thereby applying paint along the corner in a straight line without allowing paint to get on adjacent surfaces.

There has thus been outlined, rather broadly, the more important features of the invention in order that the detailed description thereof that follows may be better understood and in order that the present contribution to the art may be better appreciated.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved paint roller that has all of the advantages of prior art paint rollers and none of the disadvantages.

It is another object of the present invention to provide a new and improved paint roller that may be easily and efficiently manufactured and marketed. The simplicity of the ball and cap swivel mechanism of the present invention meets this objective.

An even further object of the present invention is to provide a new and improved paint roller that has a low cost of manufacture with regard to both materials and labor, and which accordingly is then susceptible of low prices of sale to the consuming public, thereby making such paint rollers economically available to the buying public. Again, the simplicity of the ball and cap swivel mechanism of the present invention meets this objective.

Still another object of the present invention is to provide a new paint roller that provides in the apparatuses and methods of the prior art some of the advantages thereof, while simultaneously overcoming some of the disadvantages normally associated therewith.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
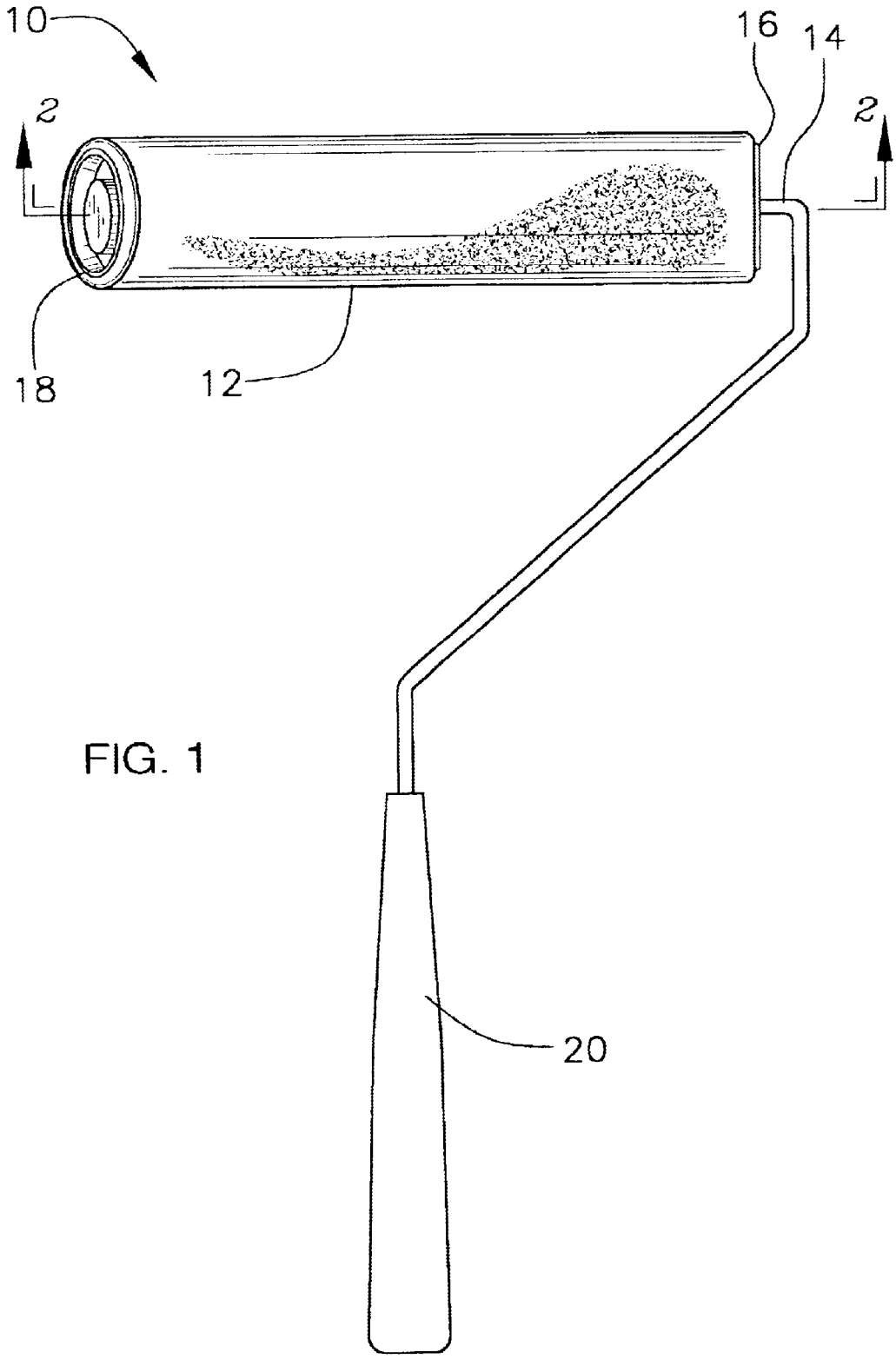
FIG. 1 is a drawing of the preferred embodiment of the paint roller constructed in accordance with the principles of the present invention.
Figure 2:
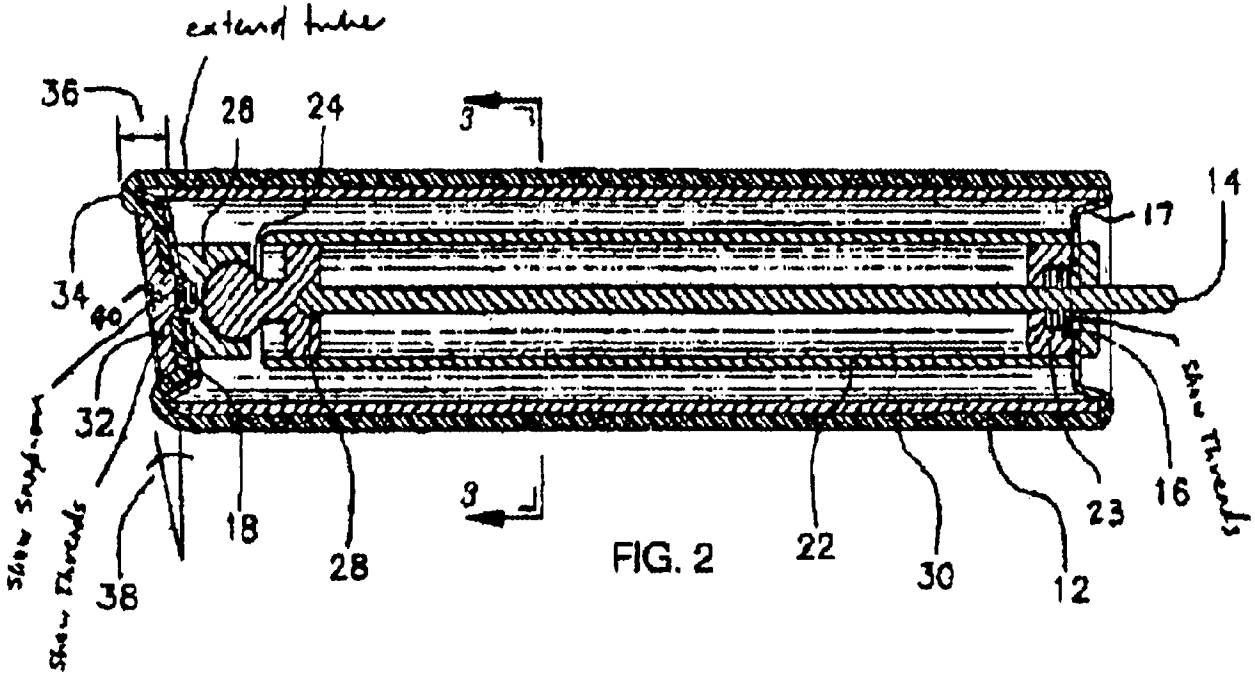
FIG. 2 is a longitudinal cross-sectional view of the paint roller of the present invention illustrating how the swivel end of the roller can be tilted at an angle for painting in corners.
Figure 3:
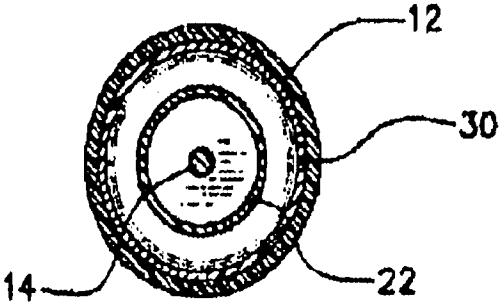
FIG. 3 is a circumferential cross-sectional view of the paint roller of the present invention.
Figure 4:
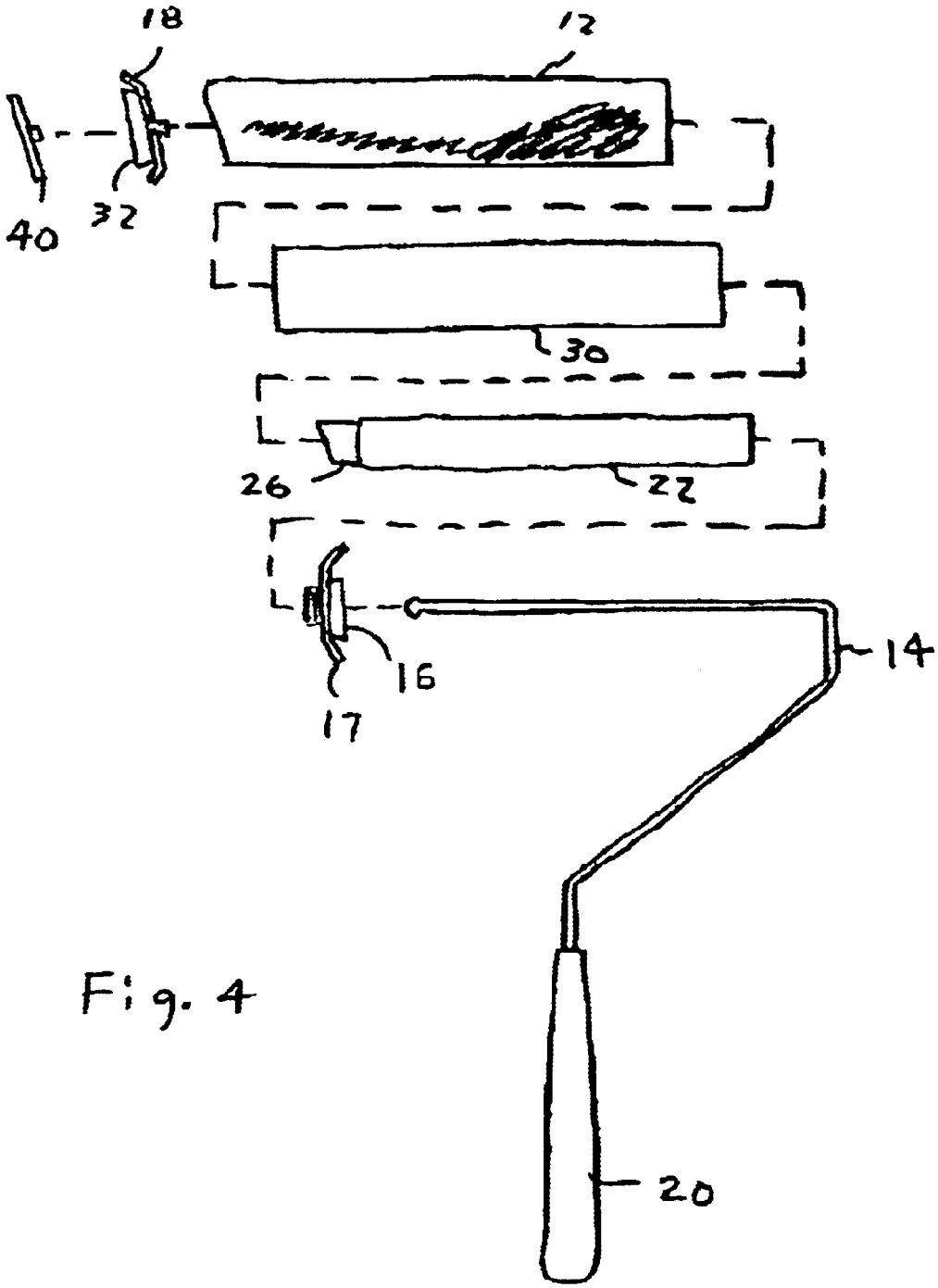
FIG. 4 is a drawing showing the assembly of the paint roller apparatus of the present invention.
Figure 5:
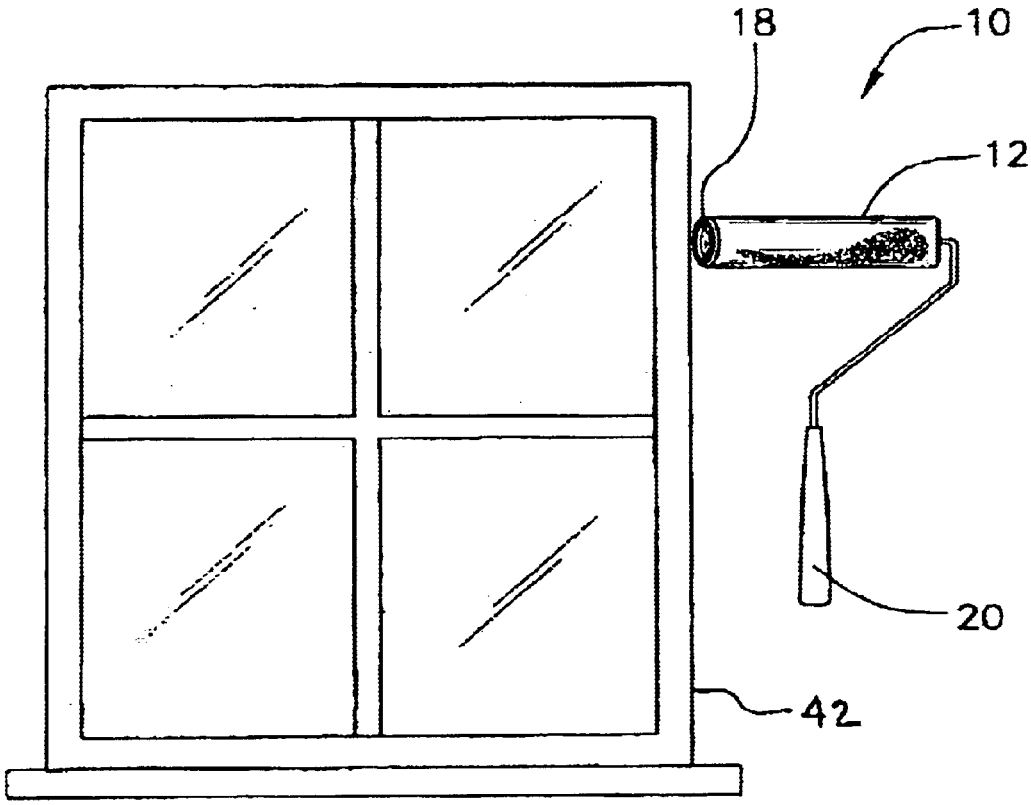
FIG. 5 is an application drawing illustrating the painting of a straight line along the edge of a window using the paint roller of the present invention.

Referring now to the drawings of FIGS. 1–5 a preferred embodiment of the paint roller of the present invention is shown and generally designated by the reference numeral 10. These figures illustrate and describe the new and improved paint roller 10 of the present invention for quickly rolling paint into corners. Particularly, FIG. 1 shows the assembled paint roller 10, FIGS. 2 and 3 show longitudinal and circumferential cross-sectional drawings, respectively, of the paint roller, FIG. 4 shows the paint roller assembly, and FIG. 5 illustrates the application of the paint roller.

In FIG. 1, the paint roller 10 has a flexible roller sock 12, for holding and dispensing paint, pulled over an outer cylindrical roller tube, which is supported by rotatable circular end-caps 16, 18. The assembly is held together by means of screws, at each end of the roller, which also are used to secure the flexible sock in place. The outer end of the roller is swiveled at an angle, allowing paint to be applied in corners along a straight line. Roller socks 12 having various fiber surfaces can be used to obtain a desired paint texture. The roller assembly is removable mounted on the roller arm portion 14 of a metal rod, which is bent to provide a handle portion perpendicular to the roller. The handle portion of the metal rod is attached to a handle 20.

More particularly, as shown in FIGS. 2 and 3, the paint roller has a rotatable inner tube 22, with a built-in swivel ball 24 and swivel block 26 assembly mounted on the outer end, which is removably pushed over the roller arm 14 and secured by means of a roller arm snap lock 28. A concentric outer roller tube 30 is placed over the inner tube 22 and rotatably supported by a circular end-cap 17 and end-cap screw 16 at the handle end of the roller and by a swivel end-cap 18 and separate swivel screw 32 at the opposite outer end of the roller. The flexible paint sock 12 is stretched over the outer tube 30, pulled over the circular end-caps 17, and swivel end-cap 18, and secured at each end of the roller by placing the sock under the screws 16; and 32.

FIG. 4 shows the paint roller 10 assembly starting with the metal roller arm 14 and attached handle 20 with a rotatable circular end-cap 17 and end-cap screw 16 placed over the roller arm to support one end of the outer roller tube 30. The inner tube 22 is then placed over the roller arm 14 and rotatable attached by means of the end-cap screw 16 being placed through the circular end-cap 17 and threaded into the inner tube bushing 23 mounted in the handle end of the inner tube 22. Next, the outer roller tube 30 is placed concentrically over the inner tube 22, where it is supported at the handle end by the circular end-cap 17. The swivel ball 24 and attached swivel block 26 are then snapped on to the roller arm snap lock 28 on the outside end of the roller arm 14 away from the handle. A flexible roller sock 12 is then stretched over the outer roller tube 30 and the outside end is secured by placing the swivel end-cap cap 18 in the end of the outer tube 30, folding the flexible roller sock 12 over the swivel end-cap 18 and securing with swivel screw 32 being threaded into the swivel block 26. Additionally, a snap-on protective end-cover plate 40 can be utilized to keep paint from accumulating at the end of the roller.

In operation, when the operator presses the roller against the surface to be painted, the swivel block 26 swivels to an angle 38 (FIG. 2) up to about 30-degrees. This stretches the flexible sock 12 by an amount 36 over the extended edge 34 of the swivel end-cap 18. As the rollers turn, the swivel end-cap 18 also turns, always at the set angle, keeping the extended portion of the flexible sock in the corner, thereby painting a straight line along the corner.

FIG. 5 is an application drawing illustrating the painting of a straight line along the edge of a window 42 using the paint roller 10 of the present invention.

Figures 6, 7:
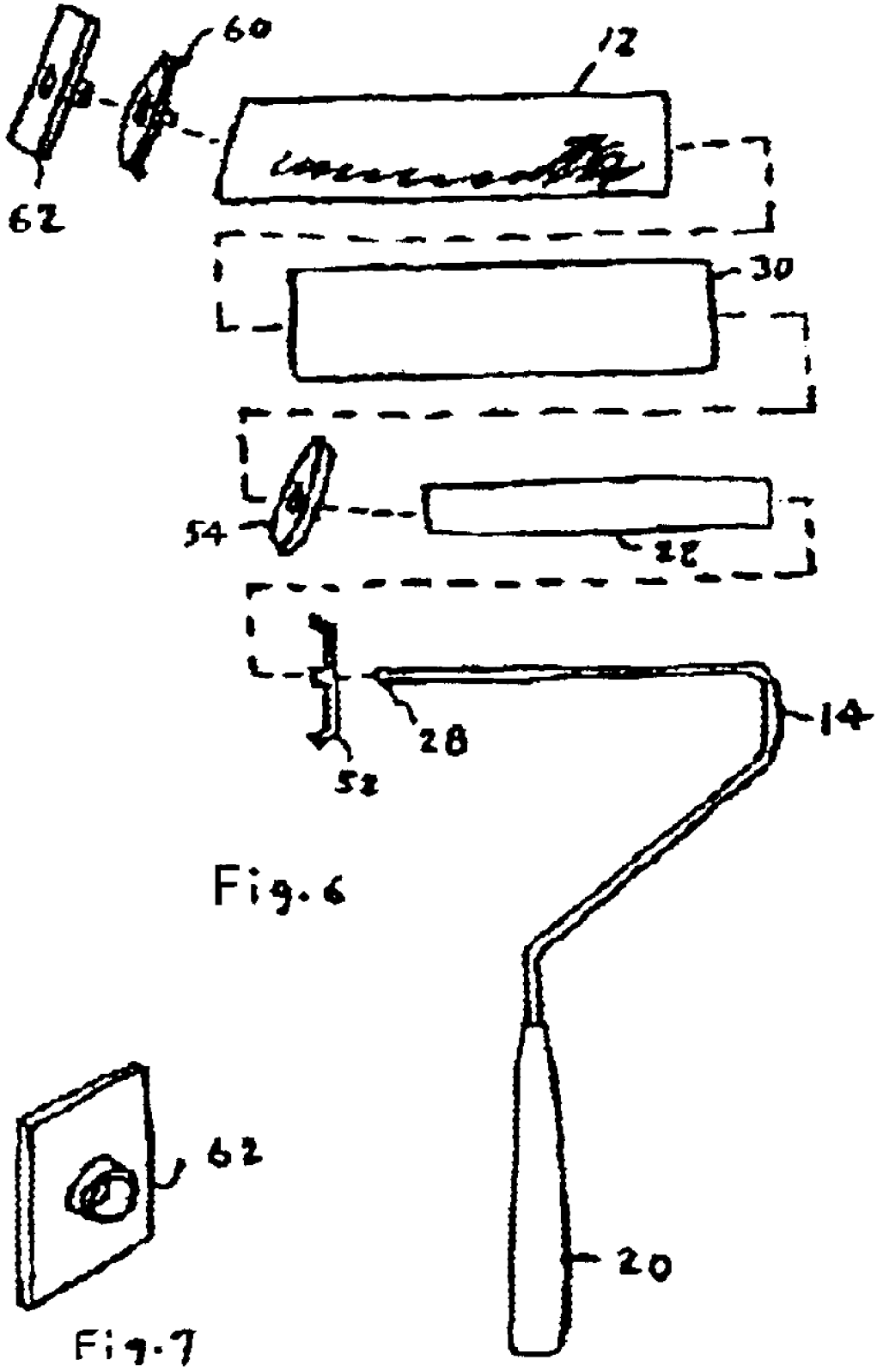
FIG. 6 is a perspective drawing of a second embodiment of the paint roller constructed in accordance with the principles of the present invention.
FIG. 7 is a perspective drawing shoving a cover plate/roller guide used with the paint roller of the second embodiment of the present invention.

FIG. 7 is a perspective drawing showing a square or rectangular cover plate/roller guide used with the paint roller of the second embodiment of the present invention.

FIG. 6 is a perspective drawing of a second embodiment of the paint roller constructed in accordance with the principles of the present invention. In this case, snap-on end-caps 52, 60 are used to hold the outer cylindrical roller tube 30 and flexible roller sock 12 in place at both ends of the roller. This embodiment of the paint roller is assembled by placing the rotatable snap-on end cap 52 on the roller arm 14 and then sliding the inner tube 22 on to the roller arm 14. The swivel end-cap 54 is connected to the exposed roller arm snap lock 28 at the outside end of the roller arm 14 away from said handle end of the roller rod 14. The outer cylindrical roller tube 30 is then placed concentrically over the inner tube 22. The flexible roller sock 12 is then stretched over the outer cylindrical roller tube 30 and the swivel end-cap 54 and secured at the outside end by means of a second snap-on end cap 60. Optionally, a rectangular cover plate/roller guide 62 can be snapped into the end-cap 60 for guiding the paint roller along door frames and other straight borders.

While a preferred embodiment of the paint roller has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal, plastic, or hard rubber may be used in fabricating the roller tubes of the paint roller apparatus.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A paint roller, comprising:

a fixed rod, a first straight portion of said rod forming a roller arm, a second portion of said rod being bent to form a handle portion perpendicular to said first roller arm portion, said second portion of said rod connected to a shaped handle;

a rotatable inner tube removably mounted on said roller arm portion of said rod, said inner tube being secured to said arm by a snap locking means;

a rotatable swivel ball attached to the outer end, opposite said handle, of said inner tube;

a rotatable swivel block mounted over said swivel ball, said swivel cap capable of being swiveled up to about 30-degrees relative to said roller arm rod;

a rotatable outer cylindrical roller tube concentrically mounted over said inner tube, said outer roller tube supported at the handle end by a rotatable circular end-cap and end-cap screw-end at the outer swivel end by a rotatable swivel end-cap and separate swivel screw, said end-cap screw being positioned over said roller arm and affixed to said handle end of said inner tube, said swivel end-cap and swivel screw affixed to said swivel end of said inner tube, said swivel screw being recessed into said swivel end cap; and a flexible cylindrical roller sock cover for holding and dispensing paint pulled tightly over said outer cylindrical roller tube, the ends of said roller sock being positioned over said rotatable end-caps and secured by said end-cap screw at said handle end and by said swivel screw at said swivel end, said roller sock being stretched outwardly parallel to said roller arm as said swivel end-cap rotates, thereby providing a diagonal outer end on said paint roller for painting a straight line in corners without applying paint to an adjacent perpendicular surface.

2. The paint roller of claim 1, wherein said swivel block freely swivels on said swivel ball to extend said roller sock in the longitudinal direction of said roller.

3. The paint roller of claim 2, wherein the length of said roller sock is extended along the line of contact between said roller and said surface being painted.

4. The paint roller of claim 3, wherein the extended portion of said roller sock is always positioned in said corner.

5. The paint roller of claim 1, wherein said roller arm portion and said bent handle portion are formed from a single metal rod.

6. The paint roller of claim 1, wherein said swivel ball and said swivel block are molded from the group of materials consisting of metal and hard plastic.

7. The paint roller of claim 1, wherein said inner tube is formed from the group of materials consisting of: sheet metal and hard plastic.

8. The paint roller of claim 1, wherein said outer second roller is formed from the group of materials consisting of: plastic, hard rubber, and metal.

9. The paint roller of claim 1, wherein said handle is formed from the group of materials consisting of: plastic, rubber, wood, and metal.

10. The paint roller of claim 1, wherein said roller sock is comprised of a soft stretchable fabric material, said material having nap fibers selectable for various paint applications.

11. The paint roller of claim 1, where a snap-on cover plate/roller guide is attached to the outside end of said paint roller away from said second portion of said rod.

12. An apparatus for painting in corners comprising:

a fixed rod, a first straight portion of said rod forming a roller arm, a second portion of said rod being bent to form a handle portion perpendicular to said first roller arm portion, said second portion of said rod connected to a shaped handle, said handle being formed from the group of materials consisting of plastic, rubber, wood, and metal, and said roller arm having a snap lock means at the outside end away from said second portion of said rod;

a rotatable inner tube removably mounted on said roller arm portion of said rod, said inner tube being secured to said arm by a snap locking means, said inner tube being formed from the group of materials consisting of: sheet metal and hard plastic;

a rotatable swivel ball attached to the outer end, opposite said handle, of said inner tube;

a rotatable swivel block mounted over said swivel ball, said swivel cap capable of being swiveled up to about 30-degrees relative to said roller arm rod;

a rotatable outer cylindrical roller tube concentrically mounted over said inner tube, said outer roller tube supported at the handle end by a rotatable circular end-cap and end-cap screw and at the outer swivel end by a rotatable swivel end-cap and separate swivel screw, said end-cap screw being positioned over said roller arm and affixed to said handle end of said inner tube, said swivel end-cap and swivel screw affixed to said swivel end of said inner tube, said swivel screw being recessed into said swivel end cap, said outer cylindrical roller being formed from the group of materials consisting of: plastic, hard rubber, and metal; and a flexible cylindrical roller sock cover for holding and dispensing paint pulled tightly over said outer cylindrical roller tube, the ends of said roller sock being positioned over said rotatable end-caps and secured by said end-cap screw at said handle end and by said swivel screw at said swivel end, said roller sock being stretched outwardly parallel to said roller arm as said swivel end-cap rotates, thereby providing a diagonal outer end on said paint roller for painting a straight line in corners without applying paint to an adjacent perpendicular surface, said roller sock being made from a soft stretchable fabric material, said material having nap fibers selectable for various paint applications.

* * * * *